US009068296B1

(12) United States Patent
Hulicsko et al.

(10) Patent No.: US 9,068,296 B1
(45) Date of Patent: Jun. 30, 2015

(54) THERMOSTATICALLY CONTROLLED ASPHALT HEATER FOR A MOBILE PAVEMENT PATCHING VEHICLE

(71) Applicant: SuperiorRoads Solutions Limited Partnership, Regina (CA)

(72) Inventors: Les Hulicsko, Regina (CA); Robert Skinner, Regina (CA)

(73) Assignee: SuperiorRoads Solutions Limited Partnership, Regina (CA)

( * ) Notice: Subject to any disclaimer, the term of this patent is extended or adjusted under 35 U.S.C. 154(b) by 0 days.

(21) Appl. No.: 14/211,962

(22) Filed: Mar. 14, 2014

(51) Int. Cl.

| | |
|---|---|
| ***E01C 23/14*** | (2006.01) |
| ***E01C 19/08*** | (2006.01) |
| ***E01C 7/18*** | (2006.01) |
| ***E01C 23/06*** | (2006.01) |

(52) U.S. Cl.
CPC ..... *E01C 19/08* (2013.01); *E01C 7/187* (2013.01); *E01C 23/06* (2013.01)

(58) Field of Classification Search
CPC ..... E01C 7/187; E01C 19/08; E01C 23/06
USPC ..... 404/77, 79, 101, 109; 222/146.2
See application file for complete search history.

(56) References Cited

U.S. PATENT DOCUMENTS

| | | | | |
|---|---|---|---|---|
| 4,545,504 | A * | 10/1985 | Fabel et al. | 222/55 |
| 4,812,076 | A * | 3/1989 | Yant | 404/108 |
| 6,832,872 | B2 * | 12/2004 | Koelm et al. | 404/108 |
| 7,300,225 | B2 * | 11/2007 | Musil | 404/79 |
| 8,342,774 | B2 * | 1/2013 | Fickeisen | 404/95 |
| 8,757,924 | B2 * | 6/2014 | Wright | 404/108 |
| 2015/0016886 | A1 * | 1/2015 | Frelich | 404/84.05 |

* cited by examiner

*Primary Examiner* — Raymond W Addie
(74) *Attorney, Agent, or Firm* — Shumaker, Loop & Kendrick, LLP

(57) ABSTRACT

A system for maintaining the temperature of the contents of an asphalt storage hopper mounted to a mobile pavement repair vehicle. The thermostatic control system directs a flow controller to direct exhaust gases from the engine of the vehicle either to the atmosphere or to a heat exchanger within the asphalt hopper in order to maintain the desired temperature. The thermostatic controller may allow an operator to select a desired temperature for the asphalt.

14 Claims, 5 Drawing Sheets

THERMOSTATICALLY CONTROLLED ASPHALT HEATER FOR A MOBILE PAVEMENT PATCHING VEHICLE

This invention is in the field of asphalt maintenance equipment, and more specifically in the field of devices for heating asphalt pavement patching material.

BACKGROUND

Paved roads are constructed from a variety of materials including concrete and asphalt. Asphalt roads provide several advantages among which is that it is rarely necessary to completely remove and reconstruct an asphalt road. Between major renovations it is common to repair smaller imperfections in the road surface, the most common of which are potholes. Typically potholes are filled with hot asphalt aggregate, which is then tamped and rolled to finish the repair.

Asphalt for use in repair is actually a mixture of materials. Typically asphalt comprises 5% asphalt/bitumen and 95% aggregates (e.g., stone, sand, gravel). Because asphalt/bitumen is highly viscous (due to the bitumen) it must be heated prior to mixing with the aggregate components, Typically, asphalt is produced on an industrial scale at asphalt plants. Once prepared, it is then dispensed to users who then transport the asphalt to the work site for use in effecting road repairs.

Typically mixing of asphalt/bitumen and aggregates is done at a temperature of about 150° C. Since the workability of the asphalt product depends on temperature, it is normally desirable to dispense and compact the asphalt before it cool to a temperature below a range from about 65-85° C. Thus, a significant problem in using asphalt for road repairs is in maintaining a proper working temperature of the asphalt from the time it leaves the plant until it is used to repair a road surface. A variety of prior art methods have attempted to address this problem.

In the past during road repair, hot asphalt material has been manually placed, and then compacted with standard rollers or tampers. More recently, a variety of mobile pothole patching vehicles have been designed to transport hot asphalt to a roadway in need of repair, and then to apply and tamp the asphalt at the repair site. In general, these vehicles comprise a cab for the operator, mounted on a vehicle chassis, the chassis also adapted to carry the asphalt storage hopper from which the asphalt is dispensed. For example, Canadian Patent Serial No. 2,026,463 disclose a mobile, self-propelled repair vehicle that makes use of a conveyor system to deliver asphalt from an on-board hopper to a pothole in a road, as well as means for compacting the asphalt in the pothole in order to effect a repair.

U.S. Pat. No. 5,988,935 (Dillingham) discloses an asphalt repair system having a dry radiant heat source located below the hopper to heat the asphalt mixture. One problem of this system is that the location of the heat source means that the asphalt mixture will be heated unevenly, and the heat source requires an additional source of fuel, increasing the cost of operation of the system. In addressing some of these issues U.S. Pat. No. 6,681,761 (Dillingham) further provides a damper system in order to retain heat within the heating chamber, with the damper being electronically controlled in response to temperature sensed within the body of the device.

U.S. Pat. No. 4,812,076 (Yant) describes an asphalt hopper heating system for heating the contents of a supply hopper mounted to a pavement-patching vehicle. The hopper tank is a double-walled construction such that there is a space between outer and inner sidewalls—exhaust gas is routed therethrough for heating the asphalt. There are a number of disadvantages with this prior art system—for example, this system requires the construction of a double-walled asphalt hopper, which increases the cost of production of the pavement-patching vehicle. In addition, heat transfers from the outside of the hopper, resulting in uneven heating of material in the middle of the asphalt load. Further, there is no means provided to ensure that the asphalt is maintained at a workable temperature.

SUMMARY OF THE INVENTION

The present invention provides an apparatus that overcomes the various limitations in prior art thermostatically controlled asphalt heaters for use in mobile pavement repair vehicles. In particular the invention provides a means of using heat from the vehicles engine exhaust to maintain the asphalt in the vehicles hopper at an optimal temperature for asphalt aggregate workability.

Exhaust gases from the vehicle engine is passed through a flow controller that directs the gases either directly to the atmosphere, or when needed, through a heat exchanger situated within the interior of the asphalt hopper. Heat flows from the heat exchanger to heats the contents of the hopper. The invention also provide a temperature sensor located within the interior of the asphalt hopper in order to sense the temperature of the hopper contents. The temperature sensor is connected to a control system that monitors temperature and uses this information to regulate the operation of the flow controller thereby providing sufficient heat to the hopper contents.

The present invention provides several advantages, one of which is to use otherwise wasted heat from the vehicle engine exhaust in order to maintain the asphalt mixture at an optimal temperature for workability.

Thus, in some embodiments the present invention provides an thermostatically controlled asphalt heater for use with a mobile, self-propelled pavement repair system, comprising: a storage hopper configured for containing a load of asphalt aggregate to be used in making a road repair; an exhaust gas conduit configured to conduct exhaust gases from an engine on the pavement repair system to a flow controller; wherein the flow controller is configured to distribute the exhaust gases to a first discharge and a second discharge; wherein the first discharge is configured to conduct the exhaust gases to the atmosphere; a heat exchanger, comprising an input configured to receive the exhaust gases from the second discharge of the flow controller, and an discharge that conducts the exhaust gases to the atmosphere; wherein the heat exchanger is disposed within the storage hopper and is in contact with the contents of the storage hopper; and wherein the heat exchanger is capable of receiving heat from the exhaust gases and transferring said heat to the contents of the storage hopper; a temperature sensor situated in the interior of the storage hopper and configured to sense a temperature of the contents of the storage hopper and to produce an discharge signal representing the temperature of the contents of the storage hopper; a thermostatic controller configured to receive the discharge signal from the temperature sensor, process the discharge signal from the temperature sensor in order to determine the temperature of the contents of the storage hopper, and to generate a control discharge signal that directs the flow controller to distribute the exhaust gases to the first discharge and second discharge in order to achieve a desired temperature for the contents of the storage hopper.

In some embodiments, the thermostatic controller is configured to maintain the contents of the storage hopper at a temperature in a range from about 65° C. to about 150° C. In some embodiments, the thermostatic controller is configured to maintain the contents of the storage hopper at a temperature in a range from about 65° C. to about 85° C.

In some embodiments, the thermostatic controller further comprises a operator readable temperature display. In some embodiments, the thermostatic controller further comprises an operator adjustable temperature selector.

In some embodiments, the discharge signal from the temperature sensor is transmitted wirelessly to the thermostatic controller. In some embodiments, the control discharge signal from the thermostatic controller is transmitted wirelessly to the flow controller.

In some embodiments, the storage hopper is mounted on a self-propelled pavement repair system.

There is also provided a method of maintaining the temperature of an asphalt paving mixture, comprising: providing a storage hopper configured for containing a load of asphalt aggregate to be used in making a road repair; providing an exhaust gas conduit configured to conduct exhaust gases from an engine on the pavement repair system to a flow controller; wherein the flow controller is configured to distribute the exhaust gases to a first discharge and a second discharge; wherein the first discharge is configured to conduct the exhaust gases to the atmosphere; providing a heat exchanger, comprising an input configured to receive the exhaust gases from the second discharge of the flow controller, and an discharge that conducts the exhaust gases to the atmosphere; wherein the heat exchanger is disposed within the storage hopper and is in contact with the contents of the storage hopper; and wherein the heat exchanger is capable of receiving heat from the exhaust gases and transferring said heat to the contents of the storage hopper; providing a temperature sensor situated in the interior of the storage hopper and configured to sense a temperature of the contents of the storage hopper and to produce an discharge signal representing the temperature of the contents of the storage hopper; providing a thermostatic controller configured to receive the discharge signal from the temperature sensor, process the discharge signal from the temperature sensor in order to determine the temperature of the contents of the storage hopper, and to generate a control discharge signal that directs the flow controller to distribute the exhaust gases to the first discharge and second discharge in order to achieve a desired temperature for the contents of the storage hopper; and operating the thermostatic controller to select the desired temperature for the contents of the storage hopper.

In some embodiments of the method, the thermostatic controller is operated to maintain the contents of the storage hopper at a temperature in a range from about 65° C. to about 150° C. In some embodiments of the method, the thermostatic controller is operated to maintain the contents of the storage hopper at a temperature in a range from about 65° C. to about 85° C. In some embodiments of the method, the system is operated by reference to an operator readable temperature display. In some embodiments of the method, selecting the desired temperature is performed by way of an operator adjustable temperature selector.

In some embodiments, the method further comprises providing wireless means to transmit the discharge signal from the temperature sensor to the thermostatic controller. In some embodiments, the method further comprises providing wireless means to transmit the control discharge signal from the thermostatic controller to the flow controller.

In some embodiments, the method further comprises mounting the storage hopper on a self-propelled pavement repair system.

Other features and advantages of the invention will be apparent from the following description in conjunction with the accompanying drawings.

BRIEF DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numerals, and where:

DETAILED DESCRIPTION OF THE INVENTION

Figure 1:
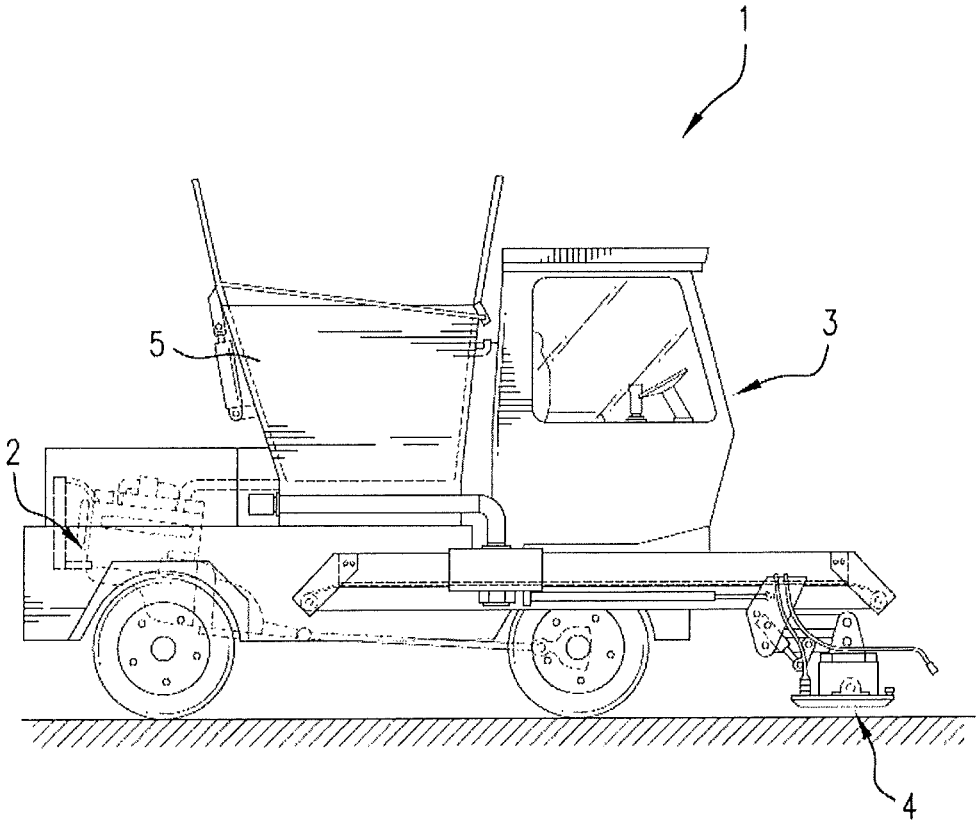
FIG. 1 is a perspective view of a prior art mobile pavement repair system such as is contemplated for use in association with the present invention.

As outlined, the present invention comprises a thermostatic asphalt heater for use in association with a mobile pavement patching system. There are several companies who manufacture mobile pavement patchers—FIG. 1 shows a perspective view of one example of a mobile pavement patcher 1 such as is contemplated herein.

Generally speaking, and for reference in association with the remainder of the disclosure herein, the mobile pavement patcher 1 comprises a chassis and drivetrain with an internal combustion engine 2 thereon. The engine is used to provide the power to drive the mobile pavement patcher 1 as well as to provide electrical, hydraulic or other power and requirements for operation of that mobile pavement patching system. Mounted on the chassis is typically an asphalt hopper 5, which is used to contain and transport asphalt aggregate for road patching purposes, and asphalt dispensing equipment 4, which might include an auger or agitator within the hopper as well as a conveyor or other discharge means for the application of asphalt aggregate from the hopper to the road surface in the conduct of a repair.

The internal combustion engine on the vehicle will include an exhaust discharge, by which exhaust gases from the operation of the internal combustion engine are discharged. A typical exhaust manifold or discharge will be understood by those skilled in the art of motor vehicle construction. Other necessary components including a fueling system for the internal combustion engine, and operator cab 3 and the like would be included on a typical mobile pavement patching system 1 in accordance with which the present invention can be used.

Figure 2:
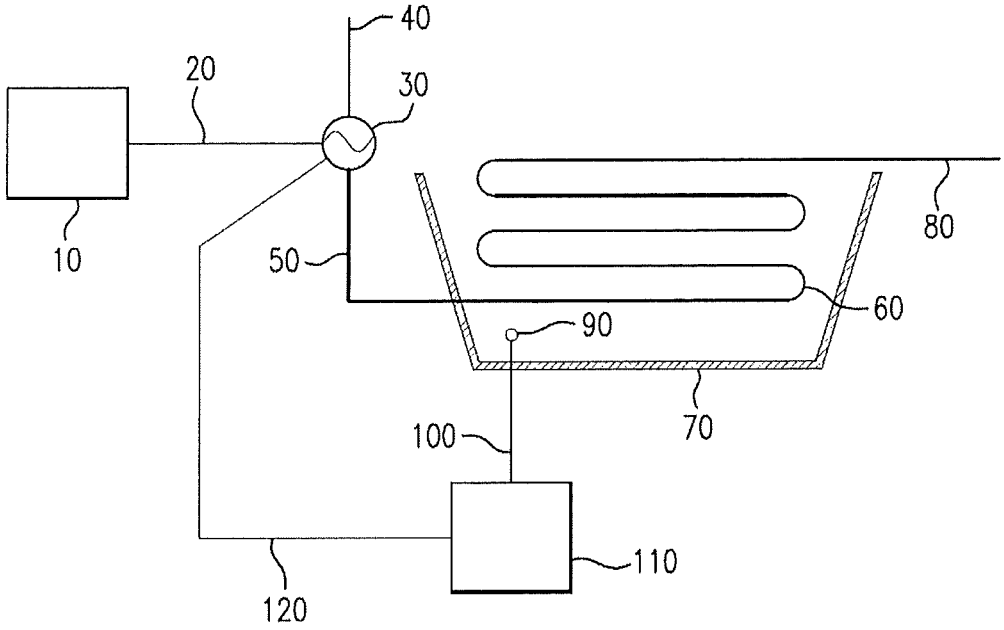
FIG. 2 is a schematic view of an embodiment of an thermostatically controlled asphalt heater of the present invention.

FIG. 2 provides a schematic representation of an embodiment of the present invention. As can be seen, the engine 10 of the vehicle discharges hot exhaust gases through a typical exhaust manifold 20. Rather than simply allowing the exhaust manifold 20 to discharge gases to the atmosphere, the exhaust gases pass from the exhaust manifold 20 into a dual-discharge flow controller 30. The flow controller 30 would be a conduit valve or the like which has an exhaust gas input from which exhaust gases are received from the manifold or exhaust discharge of the engine, and two possible discharge conduits based upon the operation of the flow controller would receive the routed exhaust gases from the engine. The first discharge is an exhaust pipe 40 that vents directly to the atmosphere, while the second discharge passes gases to an exhaust gas heat exchanger 60 situated within the interior of an asphalt hopper 70. Exhaust gases passing through the heat exchanger 60 are ultimately exhausted to the atmosphere via a heat exchanger exhaust outlet 80.

The exhaust gas heat exchanger 60 would be any type of a heat exchanger that could be mounted within the asphalt hopper 70 which was capable of the transfer of heat from exhaust gases passing therethrough from the exhaust gases to the asphalt contained within the hopper 70. From the perspective of maximizing and also distributing the heat most evenly through the asphalt within the hopper 70 it is contemplated that a heat exchanger 60 which had surface area extending through larger portions of the hopper 70 would be desirable—the different types and configurations of exhaust gas heat exchangers 60 which could be used within the asphalt hopper 70 without departing from the scope of the invention intended herein will be understood to those skilled in the art. Particular types of heat exchangers 16 might have maximum effect as well based upon the range of desired temperatures of the exhaust gases to pass therethrough as well as based upon the characteristics of typical asphalt aggregate to be heated thereby.

The flow controller 30 as outlined would likely comprise an exhaust conduit valve which had a single input and two outputs to two discharges, whereby exhaust gases received or transferred from the exhaust manifold and the internal combustion engine of the vehicle could be routed to either of the two discharges based upon a control signal applied thereto, by the remainder of the system of the present invention. Various types of flow controllers 30 which would accomplish this objective will again be obvious or understood to those skilled in the art and all such equipment or approaches are contemplated within the scope hereof.

As outlined, the flow controller 30 can be actuated or controlled to route exhaust gases from the internal combustion engine of the vehicle to one of its two discharges. The first discharge of the flow controller 30 is vented to the environment, and the second discharge is connected to the exhaust gas heat exchanger 60 mounted within the asphalt hopper 70. In operation of the flow controller 30, exhaust gases from the internal combustion engine of the vehicle can be vented directly to the environment, or passed through the exhaust gas heat exchanger 60 if heat is required to be applied within the hopper 70 to achieve or maintain the desired temperature therein.

The flow controller 30 might be "binary" in behavior, wherein it would route all of the exhaust gases from the engine either only to the environmental discharge or only to the heat exchanger discharge, or it might also be variable, wherein particularly when a heating maintenance mode was attained or desired once the asphalt within the hopper was at a particular temperature it might be desired to exhaust the portion of the exhaust gases from the engine directly to the environment and apportion to the heat exchanger—whereby the possibility of a variable discharge of exhaust gases to the exhaust gas heat exchanger could vary the speed or amount of heating applied to the asphalt within the hopper 70 by the heat exchanger 60. Both such approaches, variable or complete directional discharge of the flow controller, are contemplated within the scope hereof.

The next component of the asphalt heater of the present invention is a thermostatic controller 110. The thermostatic controller 110 is operatively connected to the flow controller 60, to provide appropriate control signals to the flow controller 60 to actuate the flow controller 60 in selectively routing exhaust gases from the engine of the vehicle either directly to the environment via the first discharge, or to the exhaust gas heat exchanger 60 via the second discharge therefrom. The thermostatic controller 110 would also be interfaced with at least one temperature sensor 90 located within or capable of sensing the temperature of the actual material contained within the hopper 70. The thermostatic controller 110 is capable of ascertaining the temperature of asphalt material contained within the hopper 70 by receiving a discharge signal or temperature indication from the at least one temperature sensor 90, and then operating the flow controller 60 based upon the temperature reading of the at least one temperature sensor 90 to obtain or maintain the desired temperature within the asphalt material stored within the hopper 70.

The at least one temperature sensor 90 can be any of a variety of sensors that are configured to produce an discharge signal that varies depending on the temperature that the sensor senses. For example, a thermocouple sensor having two dissimilar metal wires can be used. The dissimilar metals are joined at the hot junction. As temperature changes, a millivolt signal is read at the cold junction. This signal can be calibrated relative to temperature. In some embodiments, the temperature sensor 90 can comprise a resistance temperature detector (RTD), a device that measures temperature by correlating resistance of the RTD element with temperature. Those of skill in the art will readily appreciate the most appropriate type of temperature sensor 90 that is useful with the present system.

Connection of the at least one temperature sensor 90 to the thermostatic controller 110 is shown via a control input 100 in the Figure. In some embodiments the control may comprise an electrical wire connecting the temperature sensor 90 and the control system 110. In some embodiments the control input can comprise a wireless signal that is transmitted from the temperature sensor to the control system. Those of skill in the art will recognize that where wireless transmission is employed the discharge signal from the temperature sensor will be passed to a transmitter that then wirelessly passes the signal to the control system. In such cases the control system will have receiving means configured to receive the wireless signal from the temperature sensor transmitter.

Figure 3:
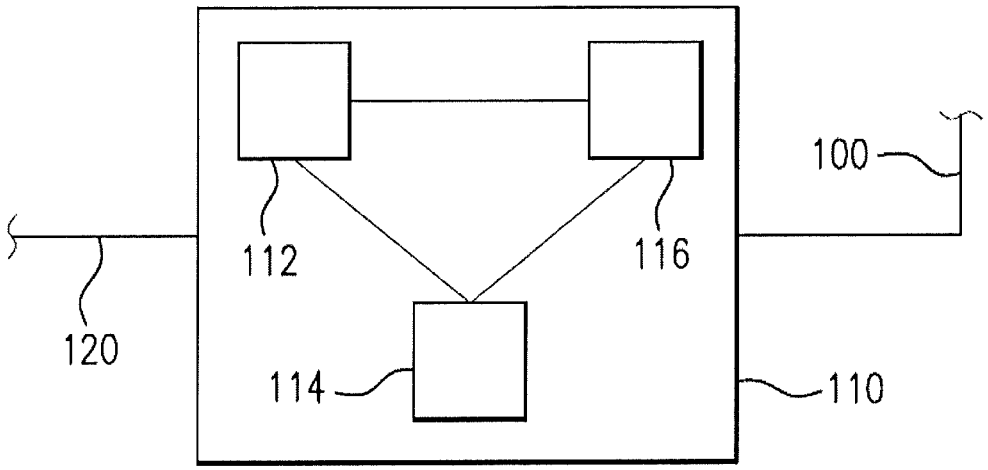
FIG. 3 is a circuit drawing of one embodiment of the exhaust gas circuit of the present invention.

FIG. 3 is a schematic diagram of the key components of one embodiment of the thermostatic controller 110 of the present invention. The controller 110 can comprise a transceiver module 112, configured to receive temperature information from the temperature sensor 90, either by a wired or wireless connection as discussed above. The transceiver module 112 is able to produce a variety of discharge signals, for example a signal to a temperature display 114 or a temperature control selector 116. When in use, an operator can determine the temperature of the contents of the asphalt hopper by referring to the temperature display. An operator can adjust the temperature control selector 116 in order to select a desired temperature. The temperature control selector 116 and/or temperature display 114 can be designed to provide warning indications if the actual temperature of the asphalt hopper contents are outside a pre-determined acceptable range relative to the selected temperature.

The temperature control selector 116 provides an discharge to the transceiver module 112. The transceiver module processes the discharge from the control selector 116 and uses that information in order to regulate the position of the flow controller 30. In some cases the flow controller 30 comprises a movable valve, or waste gate, or other similar mechanical means for diverting the flow of exhaust gases between the two discharges. Varying the position of the valve is used to regulate the proportion of vehicle exhaust that is distributed to the exhaust pipe and heat exchanger respectively. For example, where the asphalt in the hopper is below a desired temperature, the control system will send a signal to the flow controller that moves the valve with the result that a greater proportion of exhaust gases pass through the heat exchanger thus heating the asphalt in the hopper. When the asphalt has reached temperature, the system will cycle thermostatically in order to maintain a relatively constant temperature of the hopper contents. Conversely, if the asphalt temperature is higher than desired, flow to the heat exchanger can be reduced, allowing the asphalt to cool to the desired temperature, where again the system will cycle thermostatically in order to maintain a relatively constant temperature of the hopper contents.

Conveniently, the system is adaptable to current mobile pavement repair vehicles. In general the asphalt hopper can be mounted to the chassis of such a vehicle. The flow controller can be readily installed on the vehicle exhaust pipe. The control system and ancillary components are also easily installed on the vehicle, for example in the operator cab compartment.

In use, the system provides for making use of otherwise wasted heat from engine exhaust to be used in maintaining the asphalt material in the hopper at a temperature that is optimal for use in road repairs. In some cases the system will maintain the contents of the hopper at a temperature of at least 65° C. to about 85° C. In some cases it is possible to maintain the contents of the hopper at a temperature of about 150° C. Of course, the precise temperature desired will depend on a number of factors and thus the temperature selected is not considered to be limiting to the scope of the invention as described herein.

Advantageously, the system allows the operator to select temperatures over a wide range in order to provide patching material at a temperature that is optimal for making road repairs. For example, in cold weather it may be desirable to select a holding temperature that is generally higher so that the asphalt aggregate mixture remains about the optimal workability temperature long enough to be placed at the repair site and tamped to the final compaction. Conversely, in warmer climates, it may be desirable to start at a lower temperature so that the asphalt cools and hardens more rapidly. Similarly, the system is adaptable for use with various types of asphalt mixtures. Recently, there have been developed various asphalt mixtures that are workable at reduced temperatures. These "warm mix" products are also useable with the present system.

It is contemplated that the thermostatic controller 110 of the present invention could either have a preset desired temperature for the asphalt aggregate to be maintained within the hopper of the system statically designed therein, wherein no operator input would be required to select the desired temperature for asphalt, or more likely it would be desired to provide an operator selectable desired temperature setting. Both such approaches are contemplated within the scope of the present invention.

Figure 4:
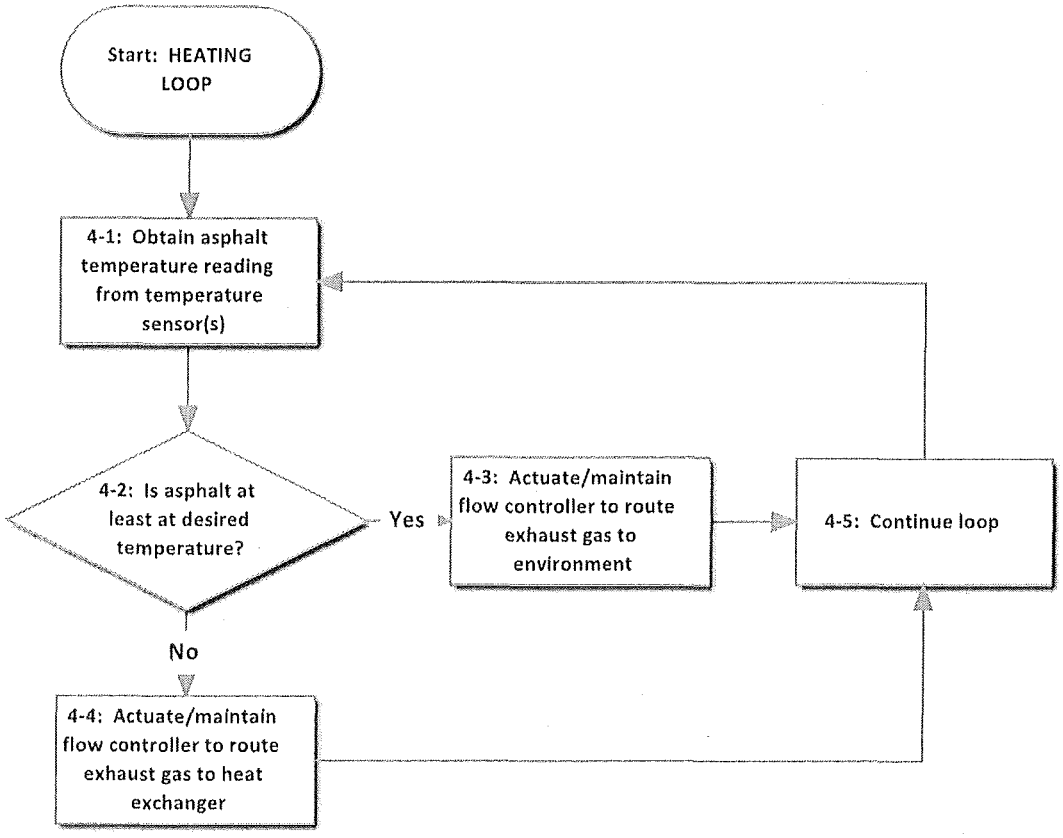
FIG. 4 is a flowchart showing the steps of one embodiment of the method of the present invention.
Figure 5:
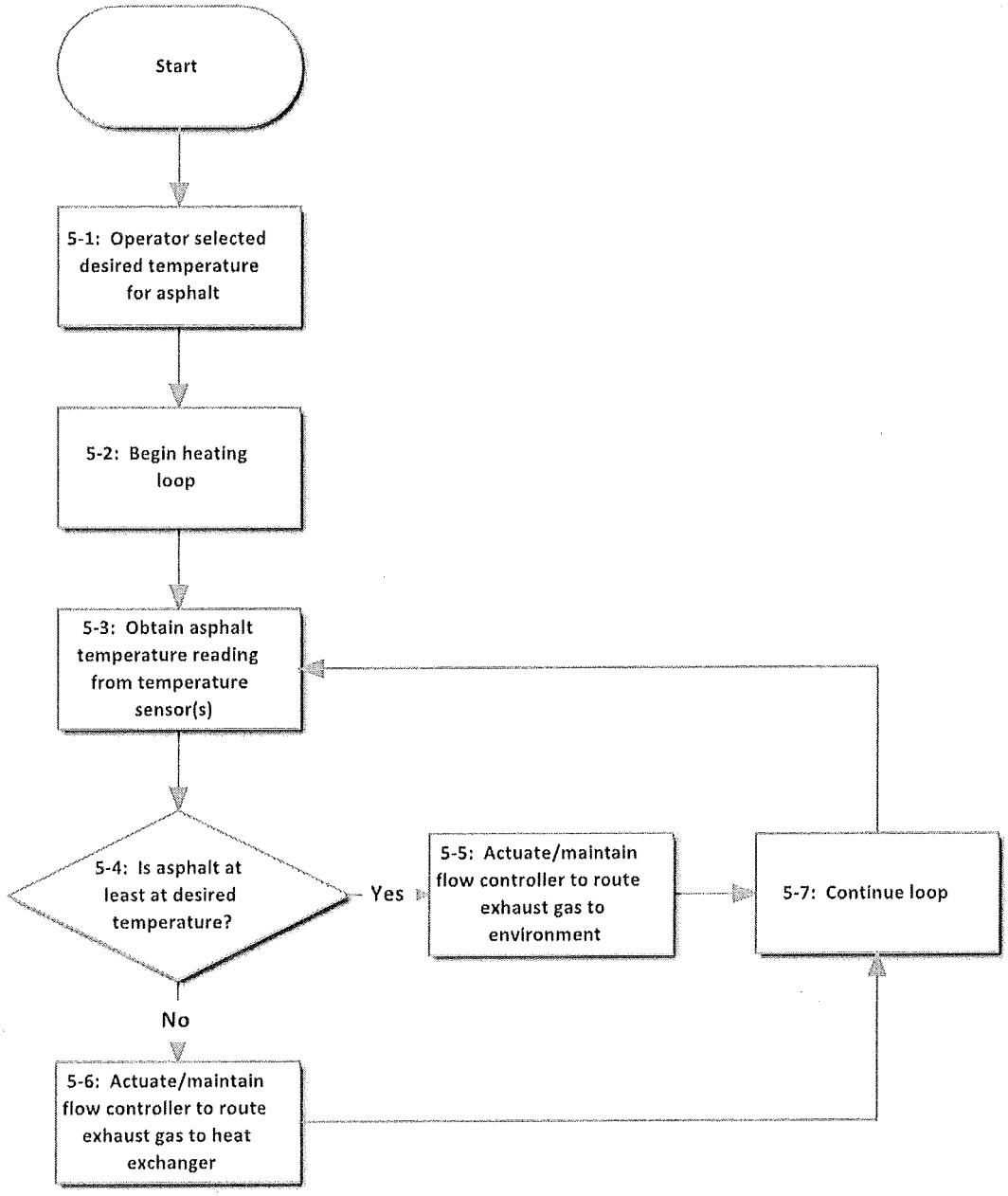
FIG. 5 is a flowchart showing the steps of another embodiment of the asphalt heating method of the present invention, including an operator selected desired temperature.

FIGS. 4 and 5 are flowcharts describing the steps in two embodiments of the asphalt heating method of the present invention. Referring first to FIG. 4 there is shown the steps of one method of heating of asphalt within a mobile asphalt heating system in accordance with the remainder of the present invention, wherein a predetermined or pre-programmed static desired temperature for the asphalt within the hopper was used. The method comprises, using a thermostatically controlled asphalt heater installed on a mobile pavement patching machine as outlined herein, effectively a method that is a heating loop. Shown at step 4-1, the thermostatic controller 110, in cooperation with the at least one temperature sensor 90 within the hopper 70, samples the temperature of the contents of the hopper 70. The controller 110 will then determine if the asphalt is at least at the desired temperature, shown at step 4-2. If the asphalt within the hopper 70 is at at least the desired temperature, the controller 110 will actuate or operate the flow controller 62 route exhaust gas from the engine to the environment directly, by routing the exhaust gas from the engine to the first discharge thereof. That is shown at step 4-3. Alternatively, if the asphalt is not at least at the desired temperature, a heating step 4-4 is shown, where the controller 110 will actuate or operate the flow controller 62 route exhaust gas through the exhaust gas heat exchanger 60 through the hopper 70, to transfer heat from the exhaust gas to the Ashcroft contained within the hopper 70. Either on an immediate and constant looping basis, or alternatively on the basis of a time-based sampling, step 4-5 shows the continuation of the heating loop in FIG. 4 by triggering another temperature pass or sampling at the appropriate time, based upon which heating of the exhaust gas within the hopper or bypass of exhaust gas straight to the environment can again be maintained or actuated in the loop. Thermostatic control of the application of heating by this method to asphalt contained within the hopper 70 of mobile pavement patching machine has enhanced effectiveness over methods of heating used in the prior art.

In this particular embodiment of the method shown in FIG. 4 it is contemplated that the selected desired temperature to maintain the asphalt within the hopper 70 would be programmed or encoded in the electronics or memory of the thermostatic controller 110 without the need for any operator interaction. It is also contemplated that in some embodiments, including the method shown in the following FIG. 5, that the thermostatic controller 110 could include an operator interface by which an operator of the apparatus could select a temperature at which the hopper 70 of its contents should be maintained.

FIG. 5 shows the steps of a modified method of asphalt heating in accordance with the remainder of the present invention, in which the operator can select the desired temperature for the asphalt. In the embodiment of the asphalt heating method shown in this Figure, an operator is permitted to select the desired temperature at which asphalt within the hopper 70 will be maintained. Shown at step 5-1, the operator will select the desired temperature for asphalt within the hopper 70 by actuation of an operator interface on or operatively connected to the thermostatic controller 110. The operator interface could comprise any number of mechanical or electronic interfaces which will be understood to those skilled in the art of electronics and control design—it is primarily contemplated that the operator interface would be a temperature dial which would operate in conjunction with an electronic readout demonstrating the selected temperature to the operator, along with potentially the current actual temperature of the asphalt within the hopper 74 an ongoing feedback function.

While this Figure shows the selection of desired temperature before the commencement of the heating loop, shown at step 5-2, it will also be understood that in the case of an embodiment of the apparatus and method of the present invention in which the thermostatic controller 110 contains or is operatively connected to a user interface by which an operator can select the desired temperature for asphalt to be maintained within the hopper 70, the operator could adjust that temperature at any time by interaction with the user interface.

Following the selection of the desired temperature for asphalt within the hopper 70 shown at step 5-1, or otherwise during the operation of the remainder of the method, a heating loop would be initiated shown at step 5-2. This again would happen either on an ongoing and real-time basis or on a periodic sampling basis—the first step in the heating loop would be to obtain a national temperature reading from the asphalt within the hopper 70 using the at least one temperature sensor 90. This is shown at step 5-3. The temperature sensor or sensors 90, in conjunction with the remainder of the electronics of the controller 110, with determine the current temperature of asphalt within the hopper 70 and compare it to the desired selected temperature made by the operator at step 5-1. The control logic would be to determine whether or not the asphalt within the hopper 70 was at least at the desired and selected temperature for asphalt within the hopper 70 selected by the operator—the logic decision block is shown at step 5-4. If the asphalt within the hopper 70 was determined to be at least at the desired temperature selected by the operator, the controller 110 would actuate or maintain the flow controller in order to route exhaust gas from the engine directly to the environment via the first discharge of the flow controller. This is shown at step 5-5. Alternatively, if heating is desired for the asphalt within the hopper 70 to attain the desired temperature, step 5-6 shows the actuation of the flow controller to route exhaust gas through the exhaust gas heat exchanger 30 to apply heat to the asphalt within the hopper 70. Step 5-7 shows the continuation or cycling of this heating loop back to a new temperature sampling step.

The methods shown in FIG. 4 and FIG. 5 are two basic embodiments of the asphalt heating method of the present invention employing a thermostatically controlled asphalt heater in accordance with the remainder of the present invention.

Thus, it is clear that the described embodiments provide an improved system for heating asphalt in the transport hopper of a mobile pavement repair vehicle. In addition, it will be apparent to those of skill in the art that by routine modification the present invention can be optimized for use in a wide range of conditions and application. It will also be obvious to those of skill in the art that there are various ways and designs with which to produce the apparatus and methods of the present invention. The illustrated embodiments are therefore not intended to limit the scope of the invention, but to provide examples of the apparatus and method to enable those of skill in the art to appreciate the inventive concept.

For example, in some embodiments, the system may be mounted on a self-contained mobile pavement repair vehicle. In some other embodiments, the system may be provided as a stand-alone unit that can be moved by another vehicle. In these cases, the storage hopper can be mounted on its own chassis and wheel system and be provided with a means of connecting to a vehicle such as through a typical towing bar or like connector.

Those skilled in the art will recognize that many more modifications besides those already described are possible without departing from the inventive concepts herein. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. A thermostatically controlled asphalt heater for use with a self-propelled pavement repair system, said pavement repair system comprising an internal combustion engine with an exhaust gas discharge, connected to a chassis drive, and an asphalt hopper and asphalt placement apparatus for the transport and placement of asphalt aggregate, wherein the asphalt heater comprises:

a) an exhaust gas heat exchanger mounted within the asphalt hopper, having an exhaust gas input and an exhaust gas discharge and being capable of receiving heat from the exhaust gases transmitted therethrough and transferring said heat to the contents of the hopper;

b) a dual-discharge flow controller connected at an inlet to the exhaust gas discharge, controllably operable to direct the discharge of exhaust gases from the engine to a first or second discharge, wherein the first discharge of the flow controller is vented to the environment and the second discharge of the flow controller is connected to the exhaust gas input of the heat exchanger;

c) at least one temperature sensor mounted within the asphalt hopper to sense the temperature of the asphalt aggregate contained therein and to Produce an discharge signal representing the temperature thereof; and d) a thermostatic controller connected to the at least one temperature sensor and the flow controller, configured to receive the discharge signal from the at least one temperature sensor, process the discharge signal from the at least one temperature sensor in order to determine the temperature of the contents of the hopper, and to generate a control discharge signal that directs the flow controller to distribute the exhaust gases to the first discharge or second discharge thereof in order to achieve a desired temperature for the contents of the storage hopper.

2. The asphalt heater of claim 1 wherein if the temperature of the asphalt aggregate is below the desired temperature, the thermostatic controller will actuate the flow controller to route the exhaust gas from the engine to the second discharge thereof.

3. The asphalt heater of claim 1 wherein if the temperature of the asphalt aggregate is at or above the desired temperature, the thermostatic controller will actuate the flow controller to route the exhaust gas from the engine to first discharge thereof.

4. The asphalt heater of claim 1, wherein the thermostatic controller further comprises an operator readable temperature display.

5. The asphalt heater of claim 1, wherein the thermostatic controller further comprises an operator adjustable temperature selector whereby the operator can select the desired temperature for the asphalt in the hopper.

6. The asphalt heater of claim 1, wherein the thermostatic controller is configured to maintain the contents of the storage hopper at a temperature in a range from about 65° C. to about 150° C.

7. The asphalt heater of claim 6, wherein the thermostatic controller is configured to maintain the contents of the storage hopper at a temperature in a range from about 65° C. to about 85° C.

8. The asphalt heater of claim 1, wherein the discharge signal from the temperature sensor is transmitted wirelessly to the thermostatic controller.

9. The asphalt heater of claim 1, wherein the control discharge signal from the thermostatic controller is transmitted wirelessly to the flow controller.

10. A method of maintaining a desired temperature of an asphalt aggregate stored within an asphalt hopper of a mobile pavement repair system comprising an internal combustion engine with an exhaust gas discharge, connected to a chassis drive, and an asphalt hopper and asphalt placement apparatus, the method comprising:

a) providing a thermostatically controlled asphalt heater, said heater comprising:

i. an exhaust gas heat exchanger mounted within the asphalt hopper, having an exhaust gas input and an exhaust gas discharge and being capable of receiving heat from the exhaust gases transmitted therethrough and transferring said heat to the contents of the hopper;

ii. a dual-discharge flow controller connected at an inlet to the exhaust gas discharge, controllably operable to direct the discharge of exhaust gases from the engine to a first or second discharge, wherein the first discharge of the flow controller is vented to the environment and the second discharge of the flow controller is connected to the exhaust gas input of the heat exchanger;

iii. at least one temperature sensor mounted within the asphalt hopper to sense the temperature of the asphalt aggregate contained therein and to produce an discharge signal representing the temperature thereof; and iv. a thermostatic controller connected to the at least one temperature sensor and the flow controller, configured to receive the discharge signal from the at least one temperature sensor, process the discharge signal from the at least one temperature sensor in order to determine the temperature of the contents of the hopper, and to generate a control discharge signal that directs the flow controller to distribute the exhaust gases to the first discharge or second discharge thereof in order to achieve a desired temperature for the contents of the storage hopper;

b) in operation of the paving system and the engine, using the asphalt heater:

i. sensing the temperature of the asphalt contents of the hopper; and ii. routing exhaust gases to the first or second discharge of the flow controller dependent upon whether heat from the heat exchanger is required to reach or maintain the desired temperature of the contents of the hopper.

11. The method of claim 10 wherein if the temperature of the asphalt aggregate is below the desired temperature, the thermostatic controller will actuate the flow controller to route the exhaust gas from the engine to the second discharge thereof.

12. The method of claim 10 wherein if the temperature of the asphalt aggregate is at or above the desired temperature, the thermostatic controller will actuate the flow controller to route the exhaust gas from the engine to first discharge thereof.

13. The method of claim 10, wherein the thermostatic controller further comprises an operator readable temperature display.

14. The method of claim 10 wherein the thermostatic controller further comprises an operator adjustable temperature selector and wherein the desired temperature for the asphalt in the hopper is selected by the operator using said temperature selector.

* * * * *